US006623624B2

(12) United States Patent
Cash et al.

(10) Patent No.: US 6,623,624 B2
(45) Date of Patent: Sep. 23, 2003

(54) PROCESS FOR PREPARATION OF FUELS AND LUBES IN A SINGLE INTEGRATED HYDROCRACKING SYSTEM

(75) Inventors: Dennis R. Cash, Novato, CA (US); Paul D. Cambern, Martinez, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 123 days.

(21) Appl. No.: 09/954,328

(22) Filed: Sep. 10, 2001

(65) Prior Publication Data

US 2003/0047486 A1 Mar. 13, 2003

(51) Int. Cl.[7] ..... C10G 45/00

(52) U.S. Cl. ..... 208/89; 208/95; 208/111; 208/58; 208/60; 208/61; 208/74; 208/97; 208/107; 208/142

(58) Field of Search ..... 208/89, 95, 111, 208/58, 60, 61, 74, 97, 107, 142

(56) References Cited

U.S. PATENT DOCUMENTS

| | | | | | |
|---|---|---|---|---|---|
| 3,891,538 | A | * | 6/1975 | Walkey | 208/50 |
| 5,580,442 | A | | 12/1996 | Kwon et al. | 208/89 |
| 5,985,132 | A | | 11/1999 | Hoehn et al. | 208/58 |
| 6,224,747 | B1 | * | 5/2001 | Cash et al. | 208/58 |
| 6,261,441 | B1 | * | 7/2001 | Gentry et al. | 208/58 |

FOREIGN PATENT DOCUMENTS

| | | | |
|---|---|---|---|
| WO | WO 97/18278 | 5/1997 | C10G/47/00 |

* cited by examiner

*Primary Examiner*—Walter D. Griffin
*Assistant Examiner*—James Arnold, Jr.
(74) *Attorney, Agent, or Firm*—Penny L. Prater

(57) ABSTRACT

An integrated distillate hydrocracking process produces one or more fuel products and one or more lube products from a first reaction stage. Heavy fractions from the first stage, which are not recovered as lube products, are cracked to fuels in a second reaction stage. This invention is intended to provide a full range of lube streams, over a wide viscosity range and a wide viscosity index range, from a fuels hydrocracker, in addition to high yields of high quality fuels.

18 Claims, 1 Drawing Sheet

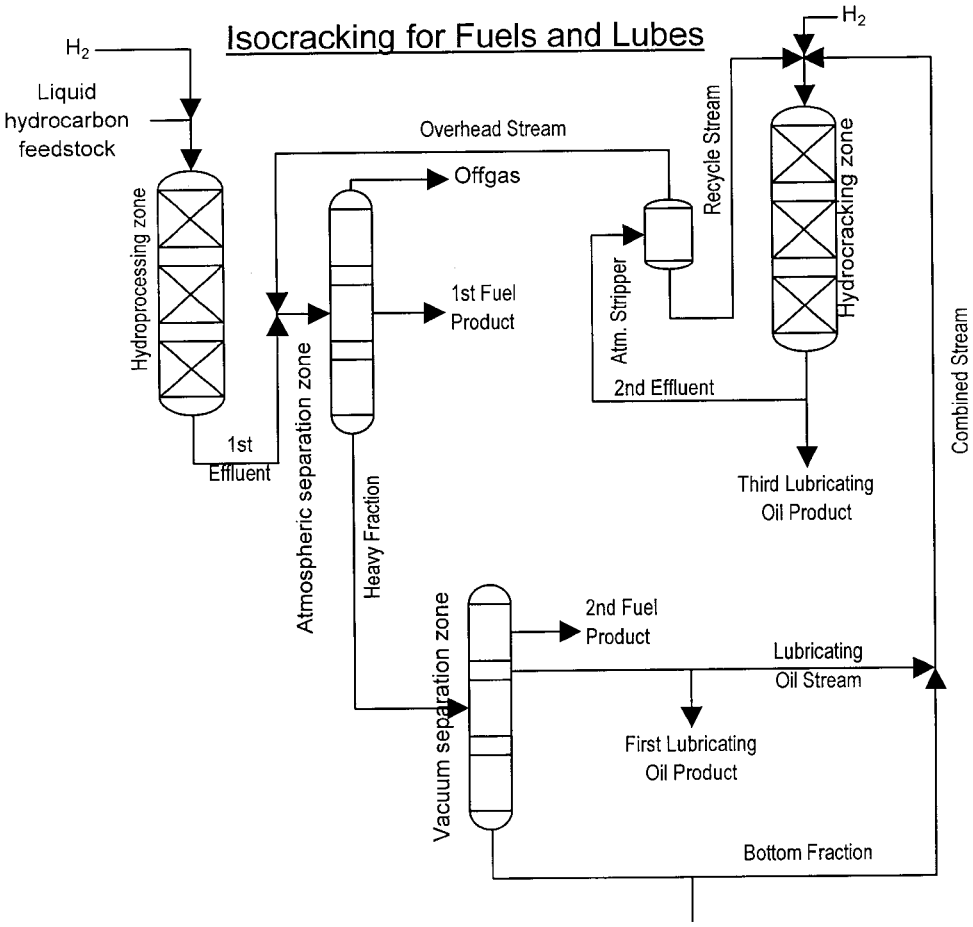

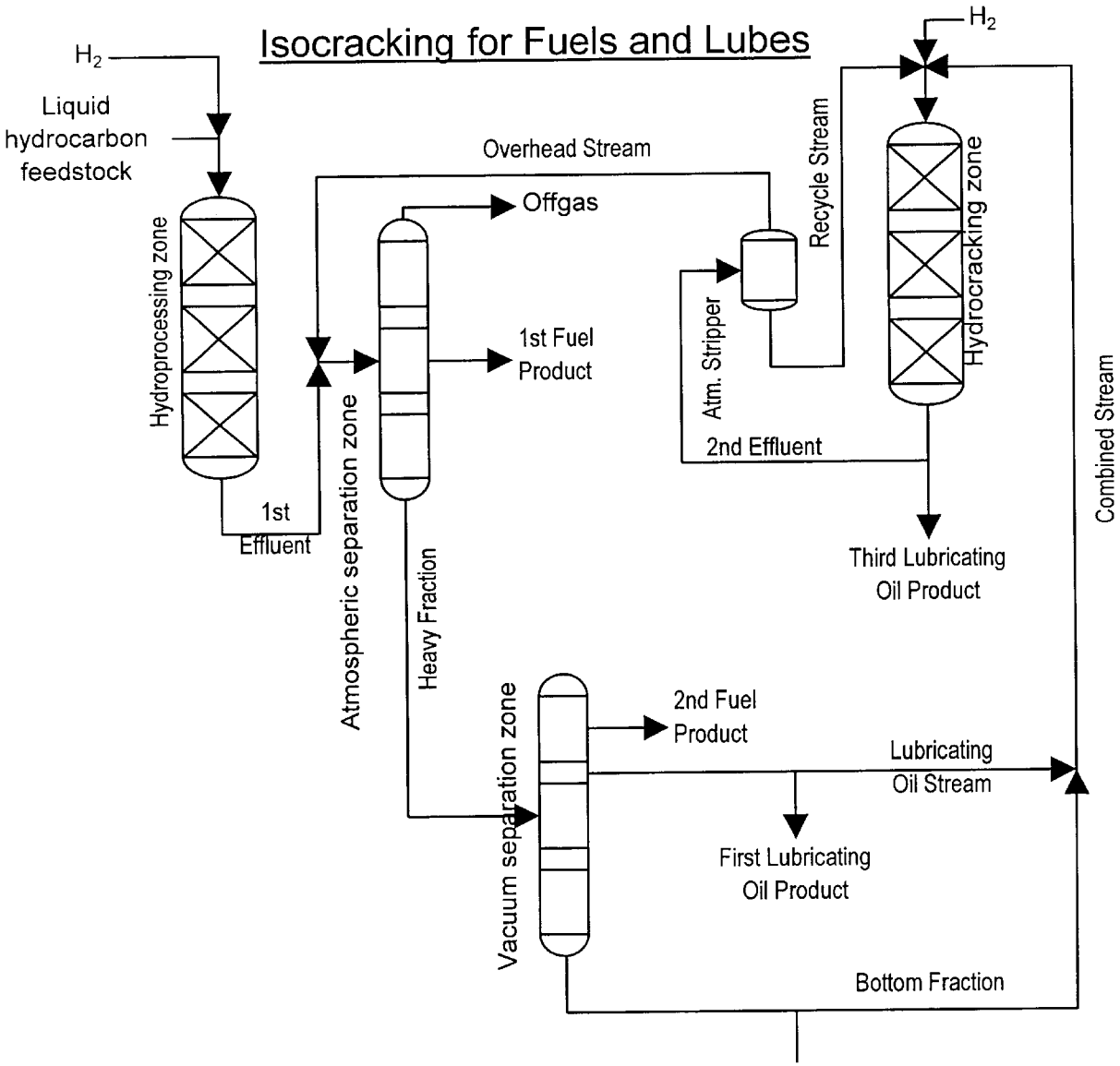
Isocracking for Fuels and Lubes
$H_2$
Liquid hydrocarbon feedstock
Hydroprocessing zone
1st Effluent
Atmospheric separation zone
Overhead Stream
Offgas
1st Fuel Product
Heavy Fraction
Vacuum separation zone
2nd Fuel Product
Lubricating Oil Stream
First Lubricating Oil Product
Bottom Fraction
Atm. Stripper
2nd Effluent
Recycle Stream
Hydrocracking zone
Third Lubricating Oil Product
$H_2$
Combined Stream

PROCESS FOR PREPARATION OF FUELS AND LUBES IN A SINGLE INTEGRATED HYDROCRACKING SYSTEM

FIELD OF THE INVENTION

This invention relates to a process for the production of fuels and lubricating base oils, and, more particularly, it relates to processes for the production of a full range of lubricating oils including high viscosity base stocks and transportation fuels in a single integrated hydrocracking system.

BACKGROUND

Hydrocracking a refinery stream to produce both fuels and lubricating oil products is a process having conflicting objectives. Fuels hydrocracking, particularly involving hydrocracking a feedstock boiling above the boiling range of the desired fuel, aims to crack a substantial portion of the refinery feedstock. It is desirable to reduce the molecular weight of virtually all of the refinery stream if possible, with substantial portion of the cracked products preferably boiling in the range of the desired fuel(s). In contrast, the ideal refinery stream suitable for use in preparing a lubricating oil product by hydrocracking boils in the range of the desired lubricating oil product, or at a slightly higher temperature. Hydrocracking removes the low boiling components of the refinery stream which are not desirable for the lubricating oil product, along with heteroatoms, while leaving the most desirable higher boiling components behind for inclusion with the lube product. The presence of some hydrocracking reaction products in the lubricating oil range are acceptable, so long as they do not predominate in any lubricating oil product fraction, and thereby unacceptably reduce the viscosity index of the lubricating oil product.

Conventional methods for producing both fuels and lubricating oil products from a single integrated hydrocracking system are optimized for one type of product, with the properties and yield of the second type of product being dictated by conditions imposed on the system. For example, a fuels hydrocracker, operated at high severity for producing fuels, may also have a lubricating oil product stream. However, the lubricating oil product recovered in this type of hydrocracking system is generally characterized by a low viscosity and often by a very high viscosity index. There is little flexibility in the type of lubricating oil product produced. Furthermore, feed to a fuels hydrocracker may be cracked numerous times through repeated recycle steps before being recovered. While repeated cracking operations are acceptable for fuels, such repeated operations are detrimental to lube properties. It is desirable to have a process for producing high yields of high quality fuels while maintaining the flexibility for selecting the desired product properties for lubricating oil product(s) recovered from the process.

Methods of producing high quality lube fraction from fuels hydrocracker bottoms have been attempted by others. The instant process is, however, directed to an integrated process for production of both fuels and lube oil products. U.S. Pat. No. 5,580,442 (Kwon et al) discloses a process in which an atmospheric residue is distilled in a first vacuum distillation unit to produce a vacuum gas oil(VGO). The VGO is hydrotreated to remove impurities, then hydrocracked. The light hydrocarbons created by cracking are then removed by distillation, and the unconverted oil is passed to a second vacuum distillation unit to produce lubes. The remaining material is then recycled to the hydrocracker.

WO 97/18278 (Bixel et al) also discloses a method for producing feedstocks of high quality lube base oil from unconverted oil of a fuels hydrocracker operating In recycle mode. A vacuum distillation unit is employed following fractionation. Any of the fractions from the vacuum distillation unit may be recycled to the hydrotreater, passed to the hydrocracker, or sent to an FCC unit. The cuts from the vacuum distillation unit need not be recycled to the hydrocracker. Kwon et al does not disclose the necessity of operating the fuels hydrocracker to produce waxy fuels hydrocracker bottoms which have the appropriate hydrogen content to obtain subsequently dewaxed basestocks having a VI of at least 115, as does Bixel et al.

U.S. Pat. No. 5,985,132 (Hoehn et al) discloses a method for producing lube blending stocks by employing a lubes hydrocracker rather than a fuels hydrocracker, as used in the instant invention. A lubes hydrocracker employs a conversion level or less than 30%. One portion of the effluent stream is directly removed from the first hydrocracking zone to produce lube blending stocks. Another portion of the effluent stream from the first hydrocracking zone is directly introduced into a second hydrocracking zone without intermediate separation, and is cracked to produced fuels. In the instant invention the effluent from the first hydroprocessing zone passes to an atmospheric separation zone.

SUMMARY OF THE INVENTION

The present invention provides a process for hydrocracking a refinery stream to produce fuels, including naphtha, kerosene and diesel fuel, while maintaining the flexibility to recover one or more high quality lubricating oil product(s). The process further provides the flexibility for preparation of lubricating oil products having a wide range of viscosities and viscosity indices.

Thus, an objective of the present invention is to produce a high quality lube fraction from a fuels hydrocracker. Another objective of the present invention is to provide a full range of lube streams, over a wide viscosity range and a wide viscosity index range, from a fuels hydrocracker. Another objective of the present invention is to provide a high viscosity index lube stream from a fuels hydrocracker.

This invention illustrates an integrated process for producing both fuels and lubricating oil products from a single integrated hydrocracking system, which produces high yields of high quality fuels, while maintaining flexibility for selecting the desired product properties for the lubricating oil products recovered from the process, comprising the steps of:

a) contacting a liquid hydrocarbon feedstock with hydrogen over a first catalyst in a hydroprocessing zone which may be operated at either hydrotreating or hydrocracking conditions, which is operated at conditions effective to remove impurities contained in the feedstock, to yield a first effluent containing a normally liquid fraction;

b) separating the normally liquid fraction from the first effluent by boiling point range to yield at least a first lubricating oil product, a first fuel product and a bottom fraction;

c) contacting at least a portion of the bottom fraction with a second catalyst in a hydrocracking zone operated at conditions effective to hydrocrack the bottom fraction, to yield a second effluent;

d) separating the second effluent by boiling point range to yield an overhead stream and a recycle stream; and (e)recycling the recycle stream to the hydrocracking zone.

In the present invention, a lubricating oil product is separated from the effluent of a hydroprocessing zone, which may be operated at either hydrotreating or hydrocracking conditions. This zone is operated at conditions preselected to achieve a lubricating oil product having the desired properties. Portions of the effluent not recovered for lubes is then hydrocracked in a hydrocracking zone to produce fuel boiling range products at high yields.

SUMMARY OF THE DRAWING

The FIGURE illustrates a preferred embodiment of the integrated fuel hydrocracking system.

DETAILED DESCRIPTION OF THE INVENTION

Feedstock

In the preferred embodiment shown in the FIGURE, a liquid hydrocarbon feedstock 2 is contacted with hydrogen 4 over a catalyst in a hydroprocessing zone 6 contained within first reactor vessel 8. A suitable liquid hydrocarbon feedstock is a VGO boiling in a temperature range above about 500° F. (260° C.), usually within the temperature range of 500°–1100° F. (260–593° C.). The term liquid refers to hydrocarbons, which are liquid at ambient conditions.

The liquid hydrocarbon feedstock, which may be used in the instant invention, contains impurities such as nitrogen and sulfur, which are removed in the hydroprocessing step. Nitrogen impurities present in the liquid hydrocarbon feedstock are usually present as organonitrogen compounds, in amounts greater than 1 ppm. Sulfur impurities are also generally present. Feeds with high levels of nitrogen and sulfur, including those containing up to 0.5 wt % (and higher) nitrogen and up to 2 wt % and higher sulfur may be treated in the present process. However, feedstocks which are high in asphaltenes and metals will usually require some kind of prior treatment, such as in a hydrotreating operation, before they are suitable for use as a feedstock for the hydroprocessing process step. A suitable liquid hydrocarbon feedstock, contains less than about 500 ppm asphaltenes, preferably less than about 200 ppm asphaltenes, and more preferably less than about 100 ppm asphaltenes. Examples of such liquid hydrocarbon feedstocks include light gas oil, heavy gas oil, vacuum gas oil, straight run gas oil, deasphalted oil, and the like. The process of the invention is also useful for upgrading oil and/or wax produced in a synthetic fuels process such as a Fischer-Tropsch process. The liquid hydrocarbon feedstock may have been processed, e.g. by hydrotreating, prior to the present process to reduce or substantially eliminate its heteroatom, metal or aromatic content. The liquid hydrocarbon feedstock may also comprise recycle components.

Hydroprocessing Zone

While the first reactor vessel 8 is shown in the FIGURE as a single reactor vessel, multiple vessels in series flow are also contemplated as being within the scope of the invention. The hydroprocessing zone 6 contained in first reactor vessel 8 may contain one or more layers of hydroconversion catalyst, each layer intended for either hydrotreating or hydrocracking reactions. Hydrotreating catalysts and hydrocracking catalysts generally are differentiated by the facility of the catalyst for removing heteroatoms from the feedstream, especially sulfur, nitrogen and/or oxygen, and for cracking the feedstock, resulting in a molecular weight reduction of the feedstock. Typical hydrotreating functions include removing heteroatoms such as sulfur and nitrogen, removing metals contained in the feed, and saturating olefins and aromatics. It is particularly desirable to remove multi-ring aromatic materials during hydrotreating, as they are particularly prone to fouling a hydrocracking catalyst, which they might contact. A measure of cracking conversion may also occur, depending on the severity of the hydrotreating conditions. Typical hydrocracking functions include, in addition to some or all of the reactions associated with hydrotreating, cracking reactions, which result in molecular weight and boiling point reduction and molecular rearrangement.

Catalyst

Hydrotreating catalysts, which are designed for removing heteroatoms and saturation reactions, will typically comprise a hydrogenation component supported on a porous refractory base such as alumina. Example hydrotreating catalysts include a hydrogenation component supported on substrate comprising silica, alumina, magnesia, titania or combinations thereof. Typically such hydrotreating catalysts are presulfided. Hydrocracking catalysts useful for the first reaction zone are also well known. In general, the hydrocracking catalyst comprises a cracking component and a hydrogenation component on an oxide support material or binder. The cracking component may include an amorphous cracking component and/or a zeolite, such as a Y-type zeolite, an ultrastable Y-type zeolite, or a dealuminated zeolite. A suitable amorphous cracking component is silica-alumina.

The hydrogenation component of the catalyst particles is selected from those elements known to provide catalytic hydrogenation activity. At least one metal component selected from the Group VIII (IUPAC Notation) elements and/or from the Group VI (IUPAC Notation) elements are generally chosen. Group V elements include chromium, molybdenum and tungsten. Group VIII elements include iron, cobalt, nickel, ruthenium, rhodium, palladium, osmium, iridium and platinum. The amount(s) of hydrogenation component(s) in the catalyst suitably range from about 0.5% to about 10% by weight of Group VIII metal component(s) and from about 5% to about 25% by weight of Group VI metal component(s), calculated as metal oxide(s) per 100 parts by weight of total catalyst, where the percentages by weight are based on the weight of the catalyst before sulfiding. The hydrogenation components in the catalyst may be in the oxidic and/or the sulphidic form. If a combination of at least a Group VI and a Group VIII metal component is present as (mixed) oxides, it will be subjected to a sulfiding treatment prior to proper use in hydrocracking. Suitably, the catalyst comprises one or more components of nickel and/or cobalt and one or more components of molybdenum and/or tungsten or one or more components of platinum and/or palladium. Catalysts containing nickel and molybdenum, nickel and tungsten, platinum and/or palladium are particularly preferred.

The hydrocracking catalyst particles and hydrotreating catalyst particles of this invention may be prepared by blending, or co-mulling, active sources of hydrogenation metals with a binder. Examples of suitable binders include silica, alumina, clays, zirconia, titania, magnesia and silica-alumina. Preference is given to the use of alumina as binder. Other components, such as phosphorous, may be added as desired to tailor the catalyst particles for a desired application. The blended components are then shaped, such as by extrusion, dried and calcined to produce the finished catalyst particles. Alternative, equally suitable methods of preparing the amorphous catalyst particles include preparing oxide binder particles, such as by extrusion, drying and calcining, followed by depositing the hydrogenation metals on the oxide particles, using methods such as impregnation. The catalyst particles, containing the hydrogenation metals, are then further dried and calcined prior to use as a catalyst.

The hydroprocessing zone may be one of a number of possible configurations. The zone may reside in one or multiple reactor vessels, each in series fluid communication with the other vessels. The zone may comprise one or more catalyst beds, each containing one or more catalysts. The hydroprocessing zone may contain only hydrotreating catalyst, or hydrocracking catalyst, or a combination of the two. The hydrotreating catalyst particles and the hydrocracking catalyst particles may be blended in a physical mixture in a single catalyst bed. Alternatively, the hydrotreating catalyst particles and hydrocracking catalyst particles may reside in separate layers of catalyst particles, each layer in fluid communication with, if present, the layer above and, if present, the layer below the reference layer. From this discussion, it will be clear that the hydroprocessing zone may contain 100% hydrotreating catalyst particles, 100% hydrocracking catalyst particles, or any combination of the two.

Reaction Conditions

The hydroprocessing zone 6 is operated in the instant invention at conditions effective to remove the impurities contained in the liquid hydrocarbon feedstock. Reaction conditions in the hydrotreating/hydrocracking zone 6 are considered to be conventional for fuels hydrotreating and hydrocracking. Suitable reaction conditions include a reaction temperature between about 250° C. and about 500° C. (482°–932° F.), pressures from about 3.5 MPa to about 24.2 MPa (500–3,500 psi), and a feed rate (volume oil/volume catalyst per hour) from about 0.1 to about 20 $hr^{-1}$. Hydrogen circulation rates are generally in the range from about 350 std liters $H_2$/kg oil to 1780 std liters $H_2$/kg oil (2,310–11,750 standard cubic feet per barrel). Preferred reaction temperatures range from about 340° C. to about 455° C. (644°–851° F.). Preferred total reaction pressures range from about 7.0 MPa to about 20.7 MPa (1,000–3,000 psi). With the preferred integrated system, it has been found that preferred process conditions include contacting a petroleum feedstock with hydrogen under hydrocracking conditions comprising a pressure of about 13.8 MPa to about 20.7 MPa (2,000–3000 psi), a gas to oil ratio between about 379–909 std liters $H_2$/kg oil (2,500–6,000 scf/bbl), a LHSV of between about 0.5–1.5 $hr^{-1}$, and a temperature in the range of 360° C. to 427° C. (680°–800° F.).

First Separation Zone

Effluent 10 containing a normally liquid fraction is recovered from hydroprocessing zone 6, and at least the normally liquid fraction is separated into two or more streams differentiated by boiling point. Details of the system of separation zones are generally dictated by local requirements. In general, the separation system of zones includes one or more single stage separation zones (not shown), for removing hydrogen and light gases, for purifying the recovered hydrogen prior to recycle or reuse elsewhere and for producing a normally liquid fraction for distillation. In the preferred embodiment illustrated in the FIGURE, some or all of the normally liquid fraction of the effluent 10 from the hydroprocessing zone is separated in one or more distillation columns. Either ambient pressure separations, sub-ambient separations, super-ambient pressure separations or a combination may be used. The separation system shown in the preferred embodiment of the FIGURE includes an atmospheric separation zone 12, operated at nominally ambient pressure and a vacuum separation zone 20, operated at sub-ambient pressure. Such distillation columns are well-known in the art, and do not require extensive explanation here. First separation zone 12 separates a first fuel product(s) 16 from an off gas stream 14 and a heavy fraction 18. Fuel product(s) 16 may include more than one stream (e.g. a naphtha/gasoline stream, a jet/kerosene stream, a diesel stream and/or a middle distillate stream), depending on the particular requirements of the refiner.

The subject process is especially useful in the production of middle distillate fractions boiling in the range of about 121°–371° C. (250°–700° F.) as determine by the appropriate ASTM test procedure. By a middle distillate fraction having a boiling range of about 121°–371° C. (250°–700° F.) is meant that at least 75 vol %, preferably 85 vol %, of the components of the middle distillate have a normal boiling point of greater than about 121° C. (250° F.) and furthermore that at least about 75 vol %, preferably 85 vol %, of the components of the middle distillate have a normal boiling point of less than 371° C. (700° F.). The term "middle distillate" is intended to include the diesel, jet fuel and kerosene boiling range fractions. The kerosene or jet fuel boiling point range is intended to refer to a temperature range of about 138°–274° C. (280°–525° F.) and the term "diesel boiling range" is intended to refer to hydrocarbon boiling points of about 121°–371° C. (250°–700° F.). Gasoline or naphtha is normally the $C_5$ to 204° C. (400° F.) endpoint fraction of available hydrocarbons. The boiling point ranges of the various product fractions recovered in any particular refinery will vary with such factors as the characteristics of the crude oil source, refinery local markets, product prices, etc. Reference is made to ASTM standards D-975 and D-3699-83 for further details on kerosene and diesel fuel properties.

Second Separation Zone

Heavy fraction (or bottoms fraction)18 includes reaction products boiling in the lube oil range, unrecovered fuel boiling range components and unreacted oil. The heavy fraction 18 is fractionated in second separation zone 20 to yield at least a second fuel product 22, one or more lube product(s) 24 and a heavy fraction 26. The second fuel product 22 is typically a middle distillate or diesel stream.

First Lubricating Oil Product

Lube product(s) 24 generally has a boiling point above about 550° F.(288° C.) or about 600° F. (316° C.) or about 650° F. (343° C.); and below about 1050° F. (566° C.), depending on the specific requirements of the process. While only a single lube product is indicated, two or more lube streams may be produced in the second separation zone 20, each having a viscosity selected from a wide range of possible viscosities, from a viscosity of 2 cSt or lower (measured at 100° C.) to a bright stock having a viscosity, measure at 100° C., between 20 and 60 cSt. The viscosity index of each lube product(s) 24 will generally greater than 90, or greater than 95, and may be up to 130 or higher. Typical lube streams which may be recovered through line 24 include a light neutral, having a 100° C. viscosity between 2 cSt and 5 cSt, a medium neutral, having a 100° C. viscosity between 5 cSt and 8 cSt, a heavy neutral having a 100° C. viscosity between 8 cSt and 20 cSt and a bright stock having a 100° C. viscosity between 20 cSt and 60 cSt.

Bottom fraction 26 is suitable for use as a lubricating oil product 28 or for passing to hydrocracking zone 36 through stream 32. Lubricating oil product 28 will generally boil at a higher temperature, and have a higher viscosity, than lubricating oil product 24. However, the viscosity and the viscosity index will generally be in the same range as for lubricating oil product 24.

Hydrocracker Feedstream

Some or all of the bottom fraction 26 is passed via stream 32 to hydrocracking zone 34 contained in second reactor vessel 36 for conversion into fuel. A portion of lubricating oil product 24 may also be passed as lubricating oil stream 30 for combination with hydrocracker feedstream 32 for passage to hydrocracking zone 34.

Hydrocracking Zone

Conversion

Hydrocracker feedstream 32 is contacted with a hydrocracking catalyst in the presence of hydrogen 38 in hydrocracking zone 34 at conditions effective to hydrocrack the hydrocracker feedstream 32 to form a second effluent 40. Preferred hydrocracking conditions are sufficient to crack a substantial portion of the hydrocracker feedstream to products boiling in a temperature range below about 700° F.(371° C.). Conversions of greater than about 25%, up to conversions of 90% and higher on a per pass basis are contemplated. As used herein, conversion is a measure of the amount of feed boiling above a reference temperature, which is converted during passage through the reaction zone into products having a boiling point below the reference temperature. A suitable reference temperature for the present process is 650° F.(343° C.).

Reaction Conditions

Reaction zone conditions and hydrocracking catalysts useful in the second reaction zone 34 may be the same as or different from those specified for the hydroprocessing zone 6.

Suitable reaction conditions include a reaction temperature between about 250° C. and about 500° C. (482°–932° F.), pressures from about 3.5 MPa to about 24.2 MPa (500–3,500 psi), and a feed rate (volume oil/volume catalyst per hour) from about 0.1 to about 20 $hr^{-1}$. Hydrogen circulation rates are generally in the range from about 350 std liters $H_2$/kg oil to 1780 std liters $H_2$/kg oil (2,310–11,750 standard cubic feet per barrel). Preferred reaction temperatures range from about 340° C. to about 455° C. (644–851° F.). Preferred total reaction pressures range from about 7.0 MPa to about 20.7 MPa (1,000–3,000 psi). With the preferred integrated system, it has been found that preferred process conditions include contacting a petroleum feedstock with hydrogen under hydrocracking conditions comprising a pressure of about 13.8 MPa to about 20.7 MPa (2,000–3000 psi), a gas to oil ratio between about 379–909 std liters $H_2$/kg oil (2,500–6,000 scf/bbl), a LHSV of between about 0.5–1.5 $hr^{-1}$, and a temperature in the range of 360° C. to 427° C. (680°–800° F.).

Catalysts

The catalyst particles in the hydrocracking zone 34 may be the same as, or different from, the hydrocracking catalyst particles useful for the hydroprocessing zone 6. It is expected, however, that properties of the catalyst particles in the hydrocracking zone 34 will fall within the same general ranges as those of the hydrocracking catalyst particles in the hydroprocessing zone 6. Thus, the hydrocracking catalyst for use in the hydrocracking zone 34 comprises a cracking component and a hydrogenation component on an oxide support material or binder. The cracking component may include an amorphous cracking component and/or a zeolite, such as a Y-type zeolite, an ultrastable Y type zeolite, or a dealuminated zeolite. A suitable amorphous cracking component is silica-alumina.

The hydrogenation component of the catalyst particles is selected from those elements known to provide catalytic hydrogenation activity. At least one metal component selected from the Group VIII (IUPAC Notation) elements and/or from the Group VI (IUPAC Notation) elements are generally chosen. Group V elements include chromium, molybdenum and tungsten. Group VIII elements include iron, cobalt, nickel, ruthenium, rhodium, palladium, osmium, iridium and platinum. The amount(s) of hydrogenation component(s) in the catalyst suitably range from about 0.5% to about 10% by weight of Group VIII metal component(s) and from about 5% to about 25% by weight of Group VI metal component(s), calculated as metal oxide(s) per 100 parts by weight of total catalyst, where the percentages by weight are based on the weight of the catalyst before sulfiding. The hydrogenation components in the catalyst may be in the oxidic and/or the sulphidic form. If a combination of at least a Group VI and a Group VIII metal component is present as (mixed) oxides, it will be subjected to a sulfiding treatment prior to proper use in hydrocracking. Suitably, the catalyst comprises one or more components of nickel and/or cobalt and one or more components of molybdenum and/or tungsten or one or more components of platinum and/or palladium. Catalysts containing nickel and molybdenum, nickel and tungsten, platinum and/or palladium are particularly preferred.

The hydrocracking catalyst particles of this invention may be prepared by blending, or co-mulling, active sources of hydrogenation metals with a binder. Examples of suitable binders include silica, alumina, clays, zirconia, titania, magnesia and silica-alumina. Preference is given to the use of alumina as binder. Other components, such as phosphorous, may be added as desired to tailor the catalyst particles for a desired application. The blended components are then shaped, such as by extrusion, dried and calcined to produce the finished catalyst particles. Alternative, equally suitable methods of preparing the amorphous catalyst particles include preparing oxide binder particles, such as by extrusion, drying and calcining, followed by depositing the hydrogenation metals on the oxide particles, using methods such as impregnation. The catalyst particles, containing the hydrogenation metals, are then further dried and calcined prior to use as a catalyst.

Third Separation Zone

Hydrocracking zone 34 is preferably operated at conditions to substantially convert hydrocracker feedstream 32 to fuel products. Second reaction zone effluent 40 is passed to third separation zone 42 for removing the middle distillate and lighter products from heavier fractions. Not shown in the FIGURE are separation zones, including flash zones and separation zones, intermediate between the second reaction zone 34 and the third separation zone 42, intended primarily for separating hydrogen and other light gases from the effluent stream. Separation zone 42 may be a single or multiple stage distillation unit, with or without added stripping fluid for improving separation efficiency. A preferred third separation zone 42 includes an atmospheric stripper. Such strippers are well known, and do nor require a detailed description. Third separation zone 42 desirably produces a recycle stream 44, which boils generally higher than fuel range fractions, and an overhead stream 46, having a boiling point in the range of fuel fractions. An example recycle stream boils in a temperature range generally above 700° F.(371° C.), and an example overhead stream boils in a temperature range generally below 700° F. Recycle stream 44 is passed to second reaction zone 34 for recracking. Overhead stream 46 is combined with first reaction zone effluent 10 for separation in first separation zone 12. The preferred contains substantially no material boiling in the lubricating oil range, i.e. boiling above about 700° F. (371° C.).

Third Lubricating Oil Product

If desired, a portion of recycle stream 44 may be recovered as third lubricating oil product 48. Typically, the lubricating oil product recovered in stream 48 will be a low viscosity, high viscosity index material. The viscosity would be expected to be in the region of 2 cSt to about 10 cSt, measured at 100° C., and the viscosity index would be expected to be above 100, often above 115, and sometimes as high as 130 or above.

Thus, in the present process, at least one lubricating oil product is recovered from the effluent from a first reaction zone, which is maintained at conditions for removing contaminants from a feedstream to the reaction zone, and for cracking the feedstream, while maintaining the flexibility for producing a lubricating oil product(s) at any desired viscosity and viscosity index over a wide range of possible values. Liquid range products from the first reaction zone which are not recovered for use as lubricating oil products are hydrocracked in a second reaction zone at conditions suitable for producing high amounts of high quality fuels, without the limitation of also achieving specified lubricating oil properties for products recovered from the second reaction zone.

What is claimed is:

1. An integrated process for producing both fuels and lubricating oil products from a single integrated hydrocracking system, which produces high yields of high quality fuels, while maintaining flexibility for selecting the desired product properties for the lubricating oil products recovered from the process, comprising the steps of:

a. contacting a liquid hydrocarbon feedstock with hydrogen over a first catalyst in a hydroprocessing zone which may be operated at either hydrotreating or hydrocracking conditions, which is operated at conditions effective to remove impurities contained in the feedstock, to yield a first effluent containing a normally liquid fraction;

b. separating the normally liquid fraction from the first effluent by boiling point range in an atmospheric separation zone to produce a first fuel product and a heavy fraction;

c. separating the heavy fraction of step (b) in a vacuum separation zone to yield a first lubricating oil product and a bottom fraction;

d. contacting at least a portion of the bottom fraction of step (c) with a second catalyst in a hydrocracking zone operated at conditions effective to hydrocrack the bottom fraction, to yield a second effluent;

e. separating the second effluent of step (d) by boiling point range to yield an overhead stream and a recycle stream: and f. recycling the recycle stream of step (e) to the hydrocracking zone.

2. The process according to claim 1 wherein at least a portion of the bottom fraction is recovered as a second lubricating oil product.

3. The process according to claim 1 further producing a second fuel product.

4. The process according to claim 1 wherein some of the first lubricating oil product is combined with the bottom fraction for contacting the catalyst in the hydrocracking zone.

5. The process according to claim 1 wherein the first lubricating oil product is derived from the first effluent only.

6. The process according to claim 1 wherein the first lubricating oil product has a viscosity, measured at 100° C. between about 2 cSt and about 60 cSt, and a viscosity index of greater than 90.

7. The process according to claim 2, wherein the second lubricating oil product has a viscosity, measured at 1000 between about 2 cSt and about 60 cSt, and a viscosity index of greater than 90.

8. The process according to claim 1 wherein the overhead stream boils in a temperature range that is within or below the middle distillate range.

9. The process according to claim 1 wherein the liquid hydrocarbon feedstock is a vacuum gas oil.

10. The process according to claim 1 wherein the liquid hydrocarbon feed stock is a synthetic product from a Fischer Tropsch process.

11. The process according to claim 10 wherein the liquid hydrocarbon feedstock is a wax from a Fischer Tropsch process, the wax having a boiling point of greater than about 650° F.

12. An integrated process for producing both fuels and lubricating oil products from a single integrated hydrocracking system, which comprises the steps of:

a. contacting a liquid hydrocarbon feedstock with hydrogen over a first catalyst in a hydroprocessing zone, which may be operated at either hydrotreating or hydrocracking conditions, and is operated at conditions effective to remove impurities contained in the feedstock, to yield a first effluent containing a normally liquid fraction, comprising a fuel product having a normal boiling point below the normal boiling point of the liquid hydrocarbon feedstock;

b. separating the first effluent from the hydroprocessing zone in an atmospheric separation zone to yield a first fuel product and a heavy fraction;

c. separating the heavy fraction in a vacuum separation zone to yield a second fuel product, a first lubricating oil product and a bottom fraction;

d. combining at least a portion of the first lubricating oil product with the bottom fraction to yield a hydrocracker feed stream;

e. contacting the hydrocracker feedstream with a second catalyst in a hydrocracking zone operated at conditions effective to hydrocrack the hydrocracker feedstream to yield a second effluent;

f. separating the second effluent to yield an overhead stream and a recycle stream; and g. combining the overhead stream with the first effluent for separation in the atmospheric separation zone.

13. The process according to claim 12 further comprising recycling the recycle stream to the hydrocracking zone.

14. The process according to claim 12 further comprising recovering at least a portion of the bottom fraction as a second lubricating oil product.

15. The process according to claim 12 further comprising recovering at least a portion of the recycle stream as a third lubricating oil product.

16. The process according to claim 12 wherein the first lubricating oil product has a viscosity, measured at 1000, between about 2 cSt and about 60 cSt, and a viscosity index of greater than 90.

17. The process according to claim 13 wherein the second lubricating oil product has a viscosity, measured at 1000, between about 2 cSt and about 60 cSt, and a viscosity index of greater than 90.

18. The process according to claim 13 wherein the third lubricating oil product has a viscosity, measured at 1000, between about 2 cSt and about 10 cSt, and a viscosity index above about 100.

* * * * *